US008847944B2

(12) United States Patent
Smith et al.

(10) Patent No.: US 8,847,944 B2
(45) Date of Patent: Sep. 30, 2014

(54) MATCHING CURRENT SOURCE/SINK APPARATUS

(75) Inventors: Euan C. Smith, Cambridge (GB); Richard Alan Page, Mountain View, CA (US); Stefan Wurster, Livermore, CA (US); Barry Thompson, Menlo Park, CA (US)

(73) Assignee: Cambridge Display Technology Limited, Cambridgeshire (GB)

( * ) Notice: Subject to any disclaimer, the term of this patent is extended or adjusted under 35 U.S.C. 154(b) by 538 days.

(21) Appl. No.: 12/680,462

(22) PCT Filed: Sep. 26, 2008

(86) PCT No.: PCT/GB2008/003296

§ 371 (c)(1), (2), (4) Date: Jun. 9, 2010

(87) PCT Pub. No.: WO2009/044116

PCT Pub. Date: Apr. 9, 2009

(65) Prior Publication Data

US 2010/0259518 A1 Oct. 14, 2010

(30) Foreign Application Priority Data

Oct. 5, 2007 (GB) ..... 0719515.9

(51) Int. Cl.

*G09G 5/00* (2006.01)
*G09G 3/32* (2006.01)
*G05F 1/46* (2006.01)

(52) U.S. Cl.

CPC ..... *G05F 1/46* (2013.01); *G09G 2310/0208* (2013.01); *G09G 2320/043* (2013.01); *G09G 2320/029* (2013.01); *G09G 3/3266* (2013.01); *G09G 3/3216* (2013.01); *G09G 3/3283* (2013.01); *G09G 2330/025* (2013.01)

USPC ..... 345/212; 345/82

(58) Field of Classification Search

USPC ..... 345/76–80, 82, 204–205, 211–214, 345/690–691; 315/169.3

See application file for complete search history.

(56) References Cited

U.S. PATENT DOCUMENTS 4,539,507 A 9/1985 VanSlyke et al.
2006/0238943 A1 * 10/2006 Awakura et al. ..... 361/93.1

(Continued)

FOREIGN PATENT DOCUMENTS

EP 0 923 067 B1 8/2004
GB 2435956 * 9/2007 ..... G09G 3/32

(Continued)

OTHER PUBLICATIONS

Examination Report for Application No. GB0719515.9, dated Mar. 8, 2012.

(Continued)

*Primary Examiner* — Joe H Cheng
*Assistant Examiner* — Keith Crawley
(74) *Attorney, Agent, or Firm* — Marshall, Gerstein & Borun LLP

(57) ABSTRACT

A current matching control apparatus for matching a plurality of current sources and a plurality of current sinks, the plurality of current sinks having a drive current value controlled by a drive processor in accordance with a reference control current and wherein each output of the plurality of current sinks are connected to a common output node; a feedback circuit having an input connected to the common output node and an output connected to the drive processor, wherein the feedback circuit is arranged to match a voltage at the common output node to a reference voltage by communicating a signal to the drive processor to adjust the reference control current.

20 Claims, 6 Drawing Sheets

(56) References Cited

U.S. PATENT DOCUMENTS

| | | | | |
|---|---|---|---|---|
| 2008/0043008 | A1* | 2/2008 | Wang | 345/211 |
| 2008/0100546 | A1 | 5/2008 | Lee et al. | |
| 2008/0191644 | A1* | 8/2008 | Liu | 315/302 |

FOREIGN PATENT DOCUMENTS

| | | | |
|---|---|---|---|
| WO | WO-90/13148 | A1 | 11/1990 |
| WO | WO-95/06400 | A1 | 3/1995 |
| WO | WO-99/21935 | A1 | 5/1999 |
| WO | WO-99/48160 | A1 | 9/1999 |
| WO | WO-01/27910 | A1 | 4/2001 |
| WO | WO-02/067343 | A1 | 8/2002 |
| WO | WO-02/091344 | A2 | 11/2002 |
| WO | WO-2006/035246 | A1 | 4/2006 |
| WO | WO-2006/035247 | A1 | 4/2006 |
| WO | WO-2006/035248 | A1 | 4/2006 |

OTHER PUBLICATIONS

Great Britain Search Report for Application No. 0719515.9, dated Jan. 4, 2008.

International Preliminary Report on Patentability for Application No. PCT/GB2008/003296, dated Apr. 7, 2010.

International Search Report and Written Opinion for Application No. PCT/GB2008/003296, dated Feb. 10, 2009.

* cited by examiner

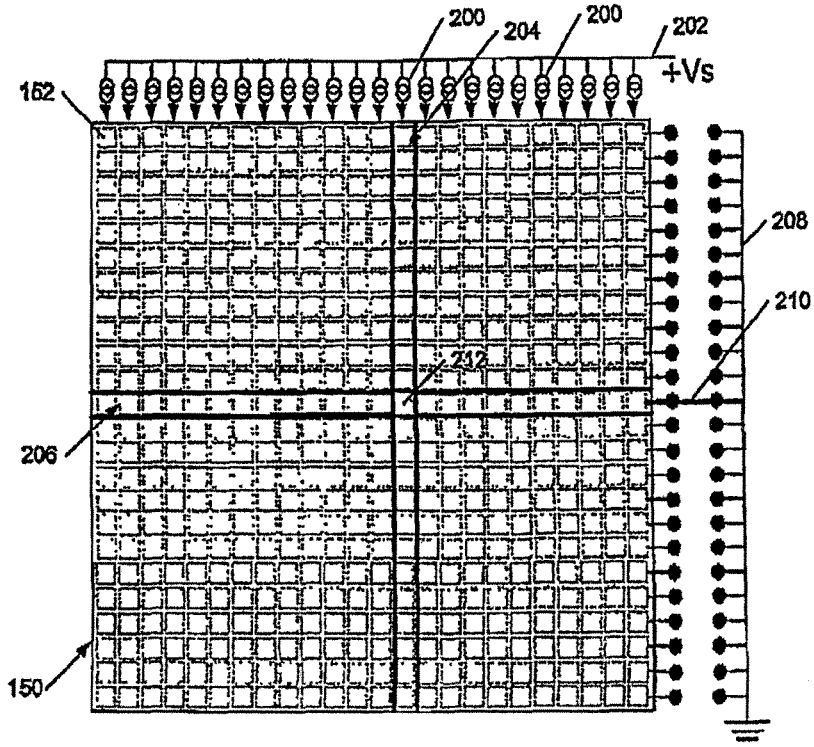
Figure 2a
Figure 2b
Figure 2c
Figure 2d
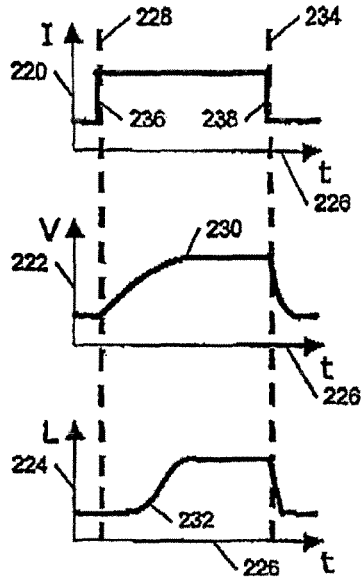

300

MATCHING CURRENT SOURCE/SINK APPARATUS

BACKGROUND OF THE INVENTION

1. Field of the Invention

Organic light emitting diodes (OLEDs) comprise a particularly advantageous form of electro-optic display. They are bright, colorful, fast switching, provide a wide viewing angle and are easy and cheap to fabricate on a variety of substrates.

2. Related Technology

Organic (which here includes organometallic) LEDs may be fabricated using either polymers or small molecules in a range of colors, depending upon the materials used. Examples of polymer-based organic LEDs are described in WO 90/13148, WO 95/06400 and WO 99/48160; examples of small molecule based devices are described in U.S. Pat. No. 4,539,507 and examples of dendrimer-based materials are described in WO 99/21935 and WO 02/067343.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108 and a cathode 110. The electroluminescent layer 108, may comprise, for example, PEDOT: PSS (polystyrene-sulphorate—doped polyethylene—dioxythiophene). Cathode layer 110 typically comprises a low work function metal such as calcium and may include an additional layer immediately adjacent electroluminescent layer 108, such as a layer of aluminum, for improved electron energy level matching. Contact wires 114 and 116 to the anode and the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example, by keeping the thickness of cathode layer 110 less than around 50-100 mm so that the cathode is substantially transparent.

Organic LEDs may be deposited on a substrate in a matrix of pixels to form a single or multi color pixilated display. A multi-colored display may be constructed using groups of red, green and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel while passive matrix displays have no such memory element and instead are repetitively scanned, somewhat similarly to a TV picture, to give the impression of a steady image.

FIG. 1*b* shows a cross-section through a passive matrix OLED display 150 in which like elements to those of FIG. 1*a* are indicated by like reference numerals. In the passive matrix display 150 the electroluminescent layer 108 comprises a plurality of pixels 152 and the cathode layer 110 comprises a plurality of mutually electrically insulated conductive lines 154, running into the page in FIG. 1*b*, each with an associated contact 156. Likewise the ITO anode layer 104 also comprises a plurality of anode lines 158, of which only one is shown in FIG. 1*b*, running at right angles to the cathode lines. Contacts (not shown in FIG. 1*b*) are also provided for each anode line. An electroluminescent pixel 152 at the intersection of a cathode line and anode line may be addressed by applying a voltage between the relevant anode and cathode lines.

Referring now to FIG. 2*a*, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Alternatively a row may be selected and all the columns written in parallel, that is a row selected and a current driven into each of the column lines simultaneously, to simultaneously illuminate each pixel in a row at its desired brightness. Although the latter arrangement requires more column drive circuitry it is preferred because it allows a more rapid refresh of each pixel. In a further alternative arrangement each pixel in a column may be addressed in turn before the next column is addressed, although this is generally not preferred because of the effect, inter alia, of column capacitance as discussed below. It will be appreciated that in the arrangement of FIG. 2*a* the functions of the column driver circuitry and row driver circuitry may be exchanged.

It is usual to provide a current-controlled rather than a voltage-controlled drive to an OLED because the brightness of an OLED is determined by the current flowing through it, thus determining the number of photons it outputs. In a voltage-controlled configuration the brightness can vary across the area of a display and with time, temperature, and age, making it difficult to predict how bright a pixel will appear when driven by a given voltage. In a color display the accuracy of color representations may also be affected.

FIGS. 2*b* to 2*d* illustrate, respectively the current drive 220 applied to a pixel, the voltage 222 across the pixel and the light output 224 from the pixel over time 226 as the pixel is addressed. The row containing the pixel is addressed and at the time indicated by dashed line 228 the current is driven onto the column line for the pixel. The column line (and pixel) has an associated capacitance and thus the voltage gradually rises to a maximum 230. The pixel does not begin to emit light until a point 232 is reached where the voltage across the pixel is greater than the OLED diode voltage drop. Similarly when the drive current is turned off at time 234 the voltage and light output gradually decay as the column capacitance discharges. Where the pixels in a row are all written simultaneously, that is where the columns are driven in parallel, the time interval between times 228 and 234 corresponds to a line scan period.

FIG. 3 shows a schematic diagram 300 of a generic driver circuit for a passive matrix OLED display. The OLED display is indicated by dashed line 302 and comprises a plurality n of row lines 304 each with a corresponding row electrode contact 308 and a plurality n of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

FIG. 4 shows schematically the main features of a current driver 402 for one column line of a passive matrix OLED display, such as the display 302 of FIG. 3. Typically a plurality of such current drivers are provided in a column driver integrated circuit, such as y-driver 314 of FIG. 3, for driving a plurality of passive matrix display column electrodes.

The current driver 402 of FIG. 4 outlines the main features of this circuit and comprises a current driver block 406 incorporating a bipolar transistor 416 which has an emitter terminal substantially directly connected to a power supply line 404 at supply voltage Vs. (This does not necessarily require that the emitter terminal should be connected to a power supply line or terminal for the driver by the most direct route but rather that there should preferably be no intervening components, apart from the intrinsic resistance of tracks or connections within the driver circuitry between the emitter and a power supply rail). A column drive output 408 provides a current drive to OLED 412, which also has a ground connection 414, normally via a row driver MOS switch (not shown in FIG. 4). A current control input 410 is provided to current driver block 406 and, for the purpose of illustration, this is shown connected to the base of transistor 416 although in practice a current mirror arrangement is preferred. The signal on current control line 410 may comprise either a voltage or a current signal. Where the current driver block 406 provides a variable controllable current source each current driver block may be interfaced with and controlled by an analog output from a digital to analog converter. Such a controllable current source can provide a variable brightness or grayscale display. Other methods of varying pixel brightness include varying pixel on time using Pulse Width Modulation (PWM). In a PWM scheme a pixel is either fully on or completely off but the apparent brightness of a pixel varies because of time integration within the observer's eye.

There is a continuing need for driver schemes which can improve the lifetime of an OLED display. There is a particular need for techniques which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. In WO 2006 035246, WO 2006 035247 and WO 2006 035248, the contents of which are herein incorporated by reference, the applicant has recognized that one solution lies in multi-line addressing techniques employed to reduce peak display drive levels, in particular in passive matrix OLED displays, and hence increase display lifetime. Broadly speaking, these methods comprise driving a plurality of column electrodes of the OLED display with a first set of column drive signals at the same time as driving two or more row electrodes of the display with a first set of row drive signals; then the column electrodes are driven with a second set of column drive signals at the same time as the two or more row electrodes are driven with a second set of row drive signals. Preferably the row and column drive signals comprise current drive signals from a substantially constant current generator such as a current source or current sink. Preferably such a current generator is controllable or programmable, for example, using a digital-to-analog converter.

The effect of driving a column at the same time as two or more rows is to divide the column drive between two or more rows in a proportion determined by the row drive signals—in other words for a current drive the current in a column is divided between the two or more rows in proportions determined by the relative values or proportions of the row drive signals. Broadly speaking this allows the luminescence profile of a row or line of pixels to be built up over multiple line scan period, thus effectively reducing the peak brightness of an OLED pixel thus increasing the lifetime of pixels of the display. With a current drive a desired luminescence of a pixel is obtained by means of a substantially linear sum of successive drive signals to the pixel.

GENERAL DESCRIPTION

The present invention is therefore concerned with improving the efficiency of, in particular, a passive matrix OLED display. Advantageously, the present invention is also compatible with multi-line addressing techniques.

Current generating circuits as discussed above in their simplest form comprise a current source and current sink. For example, as illustrated in FIG. 3, the column Y driver 314 can be considered as a current source and the row X driver 316 can be considered as a current sink although, as will be appreciated by a person skilled in the art, the functions can be revered.

Whether a current $I_{sink}$ or source current $I_{source}$ are matched depends upon a number of factors including transistor characteristics and operating parameters such as voltage levels. In operation, mismatched drivers are the cause of streaking in a display, for example, where individual columns are driven harder than neighboring columns. Over time mismatched drivers can drift towards a matched condition normally at a maximum voltage level. Such a matched condition can waste power if such a maximum voltage level is not required and can also be detrimental to the lifetime of an OLED display.

According to a first aspect of the present invention, there is provided a current matching control apparatus for matching a plurality of current sources and a plurality of current sinks, the plurality of current sinks having a drive current value controlled by a drive processor in accordance with a reference control current and wherein each output of the plurality of current sinks are connected to a common output node; a feedback circuit having an input connected to the common output node and an output connected to the drive processor, wherein the feedback circuit is arranged to match a voltage at the common output node to a reference voltage by communicating a signal to the drive processor to adjust the reference control current.

Preferably, each one of the plurality of current sinks is connected to the common output node via a first resistance component. Preferably, a second resistance component is connected between the common output node and a reference voltage source. More preferably, the feedback circuit comprises a comparator having a first input connected to sense the reference voltage and a second input connected to sense the voltage at the common output mode. The comparator may further comprise an output terminal connected to the drive processor. Preferably, the comparator is programmed to output a signal to indicate whether the reference voltage is higher or lower than the sensed voltage at the common output mode.

In a preferred embodiment, the apparatus of the present invention is included in a row driver circuit for a passive matrix driven display. Accordingly, the row driver circuit is connected to the plurality of current sinks and a column driver circuit is connected to the plurality of current sources. More preferably, the passive matrix driven display is an emissive display and even more preferably the emissive display comprises an array of individual emissive pixels provided by organic electroluminescent material. Suitable organic electroluminescent material can be selected from small molecule material or polymer organic material.

According to a second aspect of the present invention, there is provided a method of matching multiple current sources and sinks in a passive matrix driven organic electroluminescent display comprising: driving a plural set of first electrodes with a first current value; driving a plural set of second electrodes with a second current value; sensing a voltage across the plural set of second electrodes; comparing the sensed voltage across the plural set of second electrodes to a reference voltage; and adjusting the second current value so that the sensed voltage steps towards the reference voltage.

Preferably, the step of sensing a voltage across the plural second electrodes includes sensing an average voltage of the plurality of second electrodes.

Preferably, the step of adjusting the second current value includes generating a signal to indicate whether the sensed voltage is higher or lower than the reference voltage. The signal can be a single bit.

In preferred embodiments, the first electrodes comprise column electrodes and the second electrodes comprise row electrodes of the display and driving said column and row electrodes includes driving with first and second sets of column drive signals and first and second sets of row drive signals respectively. Preferably, the method includes driving the column electrodes of the display with the first set of column drive signals at the same time as driving two or more row electrodes of the display with the first set of row drive signals; then driving the column electrodes with the second set of column drive signals at the same time as two or more row electrodes are driven with a second set of row drive signals. More preferably, the first and second column drive signals and said first and second row drive signals are selected such that a desired luminescence of pixels in the display driven by the row and column electrodes is obtained by a substantially linear sum of luminances determined by the first row and column drive signals and luminances determined by the second row and column drive signals.

BRIEF DESCRIPTION OF THE DRAWINGS

Embodiments of the invention will now be described, by way of example only, and with reference to the accompanying drawings in which:

FIGS. 2*a* to 2*d* show, respectively, a conceptual driver arrangement for a passive matrix OLED display, a graph of current drive against time for a display pixel, a graph of pixel voltage against time, and a graph of pixel light output against time;

DETAILED DESCRIPTION

Figure 1A:
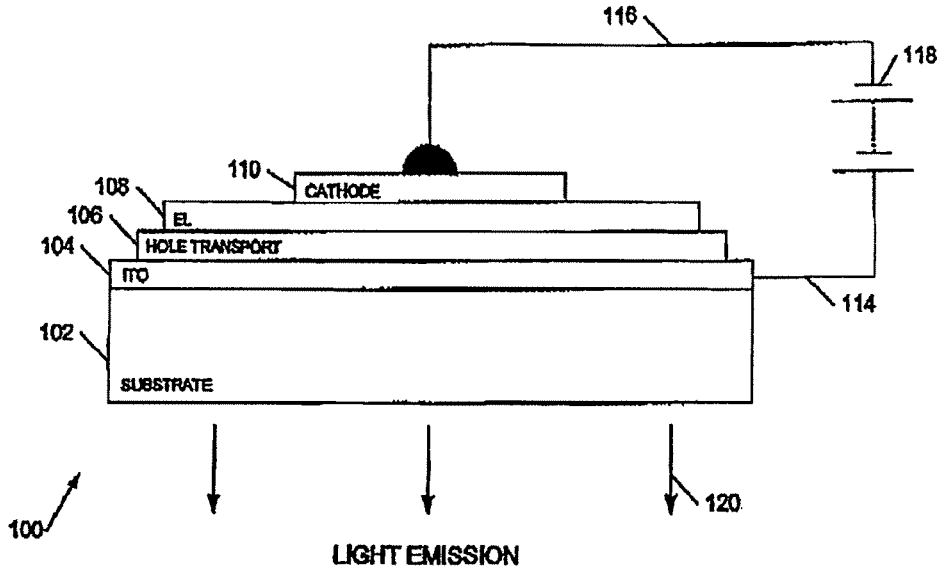
Figure 1a (PRIOR ART)
FIGS. 1*a* and 1*b* show cross sections through, respectively, an organic light emitting diode and a passive matrix OLED display.
Figure 1B:
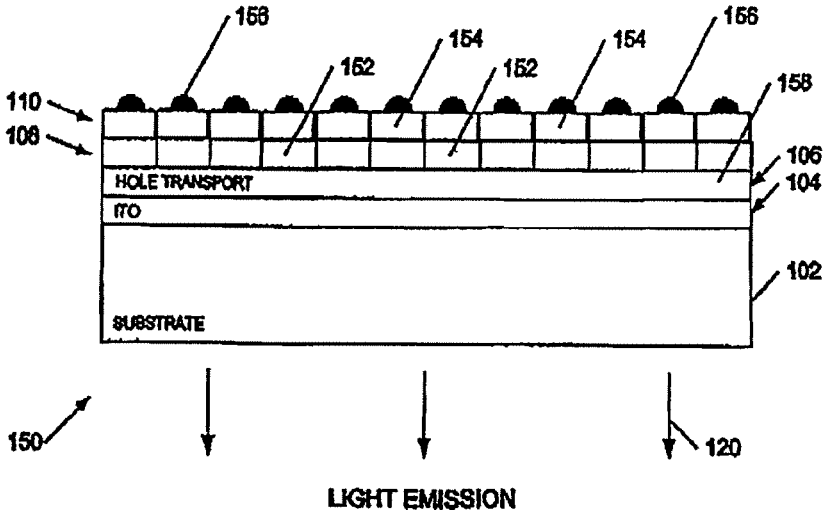
Figure 1b (PRIOR ART)
Figure 3:
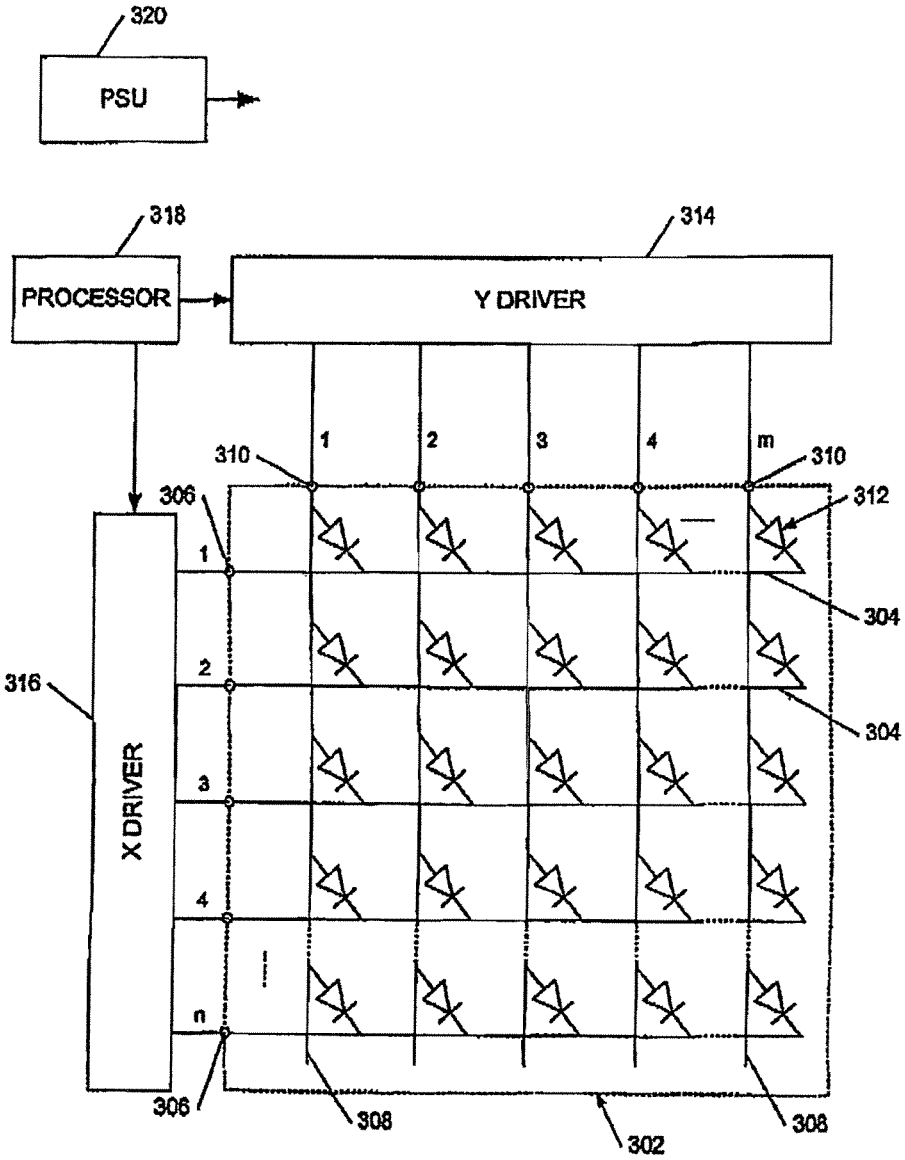
Figure 3 (PRIOR ART)
FIG. 3 shows a schematic diagram of a generic driver circuit for a passive matrix OLED display according to the prior art.
Figure 4:
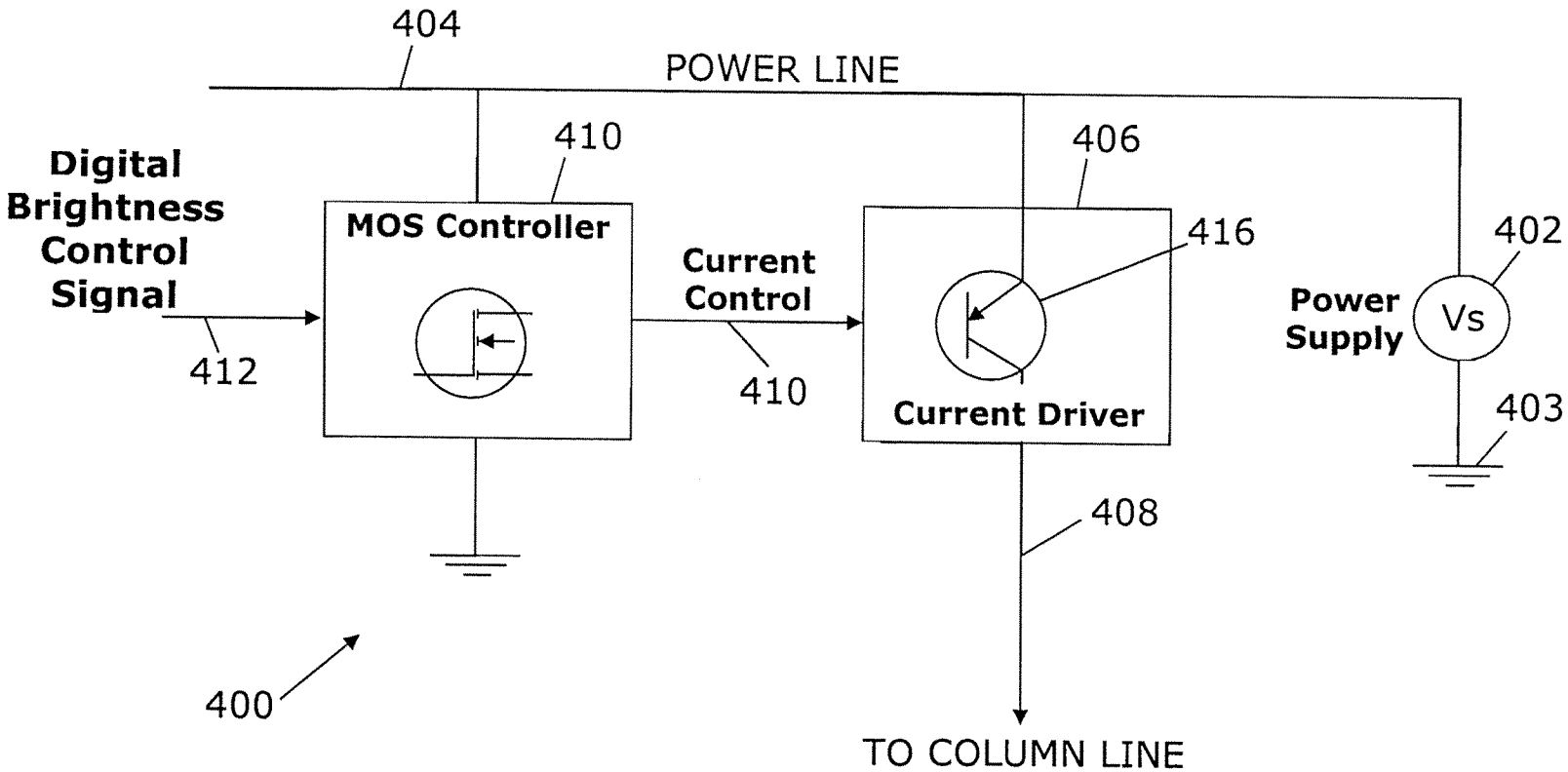
FIG. 4 shows a block diagram of a passive matrix OLED display driver.
Figure 5:
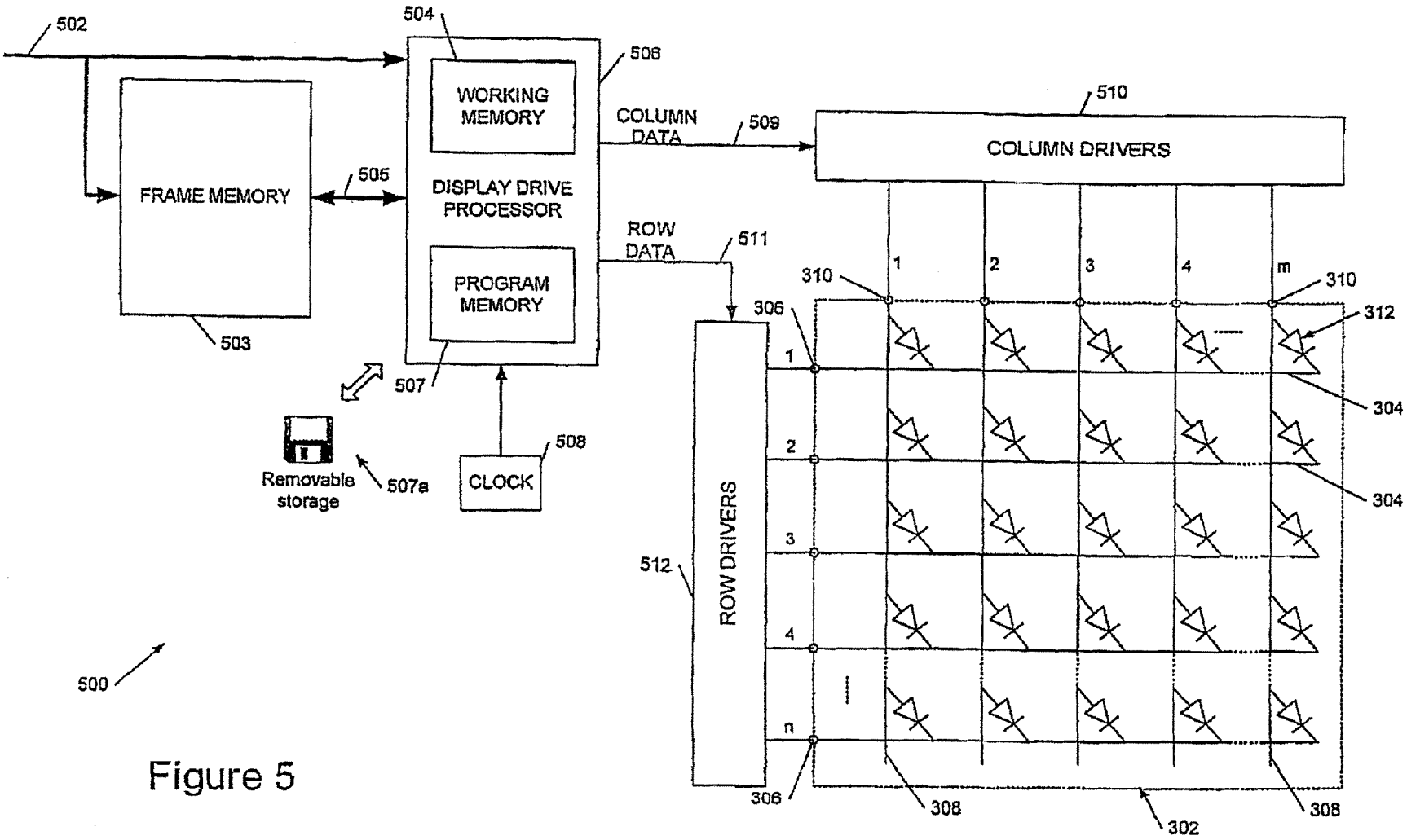
FIG. 5 is a schematic diagram of passive matrix driven OLED display according to an embodiment of the present invention.
Figure 6:
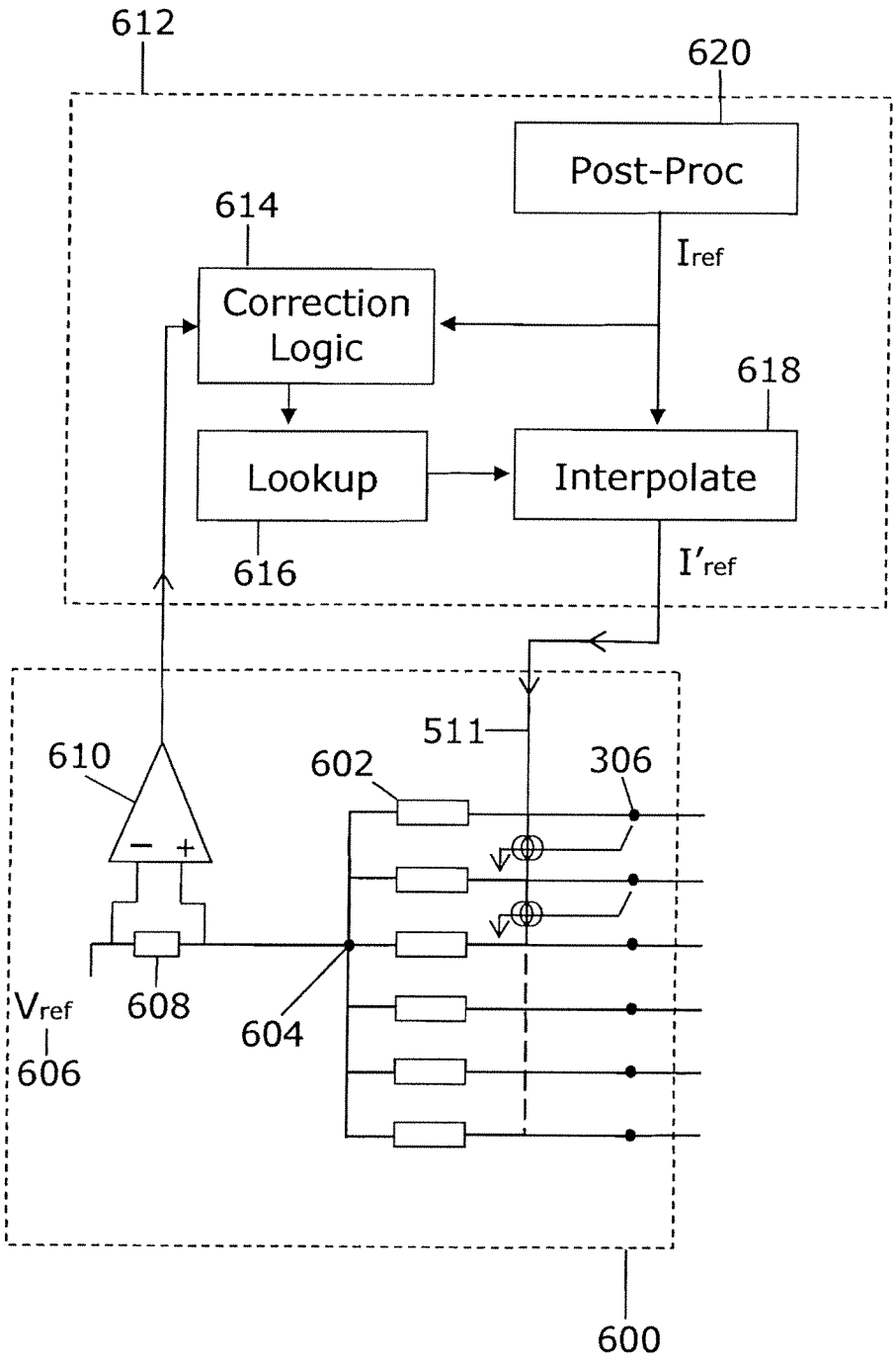
FIG. 6 is a schematic diagram of a row driver according to an embodiment of the present invention.

In FIG. 5 a passive matrix OLED display similar to that described with reference to FIG. 3 has row electrodes 306 driven by row driver circuits 512 and column electrodes 310 driven by column drives 510. Further details of the row driver circuits 512 according to the present invention are shown in FIG. 6. Column drivers 510 have a column data input 509 for setting the current drive to one or more of the column electrodes; similarly row drivers 512 have a row data input 511 for setting the current drive ratio to two or more of the rows. Preferably inputs 509 and 511 are digital inputs for ease of interfacing; preferably column data input 509 sets the current drives for all the m columns of display 302.

Data for display is provided on a data and control bus 502, which may be either serial or parallel. Bus 502 provides an input to a frame store memory 503 which stores luminance data for each pixel of the display or, in a color display, luminance information for each sub-pixel (which may be encoded as separate RGB color signals or as luminance and chrominance signals or in some other way). The data stored in frame memory 503 determines a desired apparent brightness for each pixel (or sub-pixel) for the display, and this information may be read out by means of a second, read bus 505 by a display drive processor 506 (in embodiments bus 505 may be omitted and bus 502 used instead).

Display drive processor 506 may be implemented entirely in hardware, or in software using, say, a digital signal processing core, or in a combination of the two, for example, employing dedicated hardware to accelerate matrix operations. Generally, however, display drive processor 506 will be at least partially implemented by means of stored program code or micro code stored in a program memory 507, operating under control of a clock 508 and in conjunction with working memory 504. Code in program memory 507 may be provided on a data carrier or removable storage 507*a*.

The code in program memory 507 is configured to implement one or more of multi-line addressing methods using conventional programming techniques. In some embodiments these methods may be implemented using a standard digital signal processor and code running in any conventional programming language. In such an instance a conventional library of DSP routines may be employed, for example, to implement singular value decomposition, or dedicated code may be written for this purpose, or other embodiments not employing SVD may be implemented such as the techniques described above with respect to driving color displays.

Referring to FIG. 6, a schematic diagram of a row driver 600 according to an embodiment of the present invention comprises each of the plurality of row electrodes 306 connectable to row data input 511. Each of the plurality of row electrodes 306 is further connected to a high value resistor 602, where the number of high value resistors 602 is provided to match the number of row electrodes 306. Each high value resistor 602 and correspondingly each row electrode 306 are also connected to a common node 604 which is connected to a reference voltage generator 606 through reference resistor 608.

A comparator 610 is connected across the reference resistor 608 having a positive input terminal connected between the reference resistor 608 and the common node 604 and a negative input terminal connected between the reference resistor 608 and the reference voltage generator 606. An output terminal of the comparator 610 is connected to a digital controller 612 which comprises a correction logic module 614, a correction look-up table 616, a correction interpolator 618 and a post-processing module 620.

In operation, an average row voltage of the driven row electrodes 306 is provided at the common node 604. If the average row voltage of the driven row electrodes 306 is above a reference voltage generated by the reference voltage generator 606 then a current flows into the common node 604 and out to the reference voltage generator 606. If the average row voltage of the driven row electrodes 306 is below a reference voltage generated by the reference voltage generator 606 a current flows out from reference voltage generator 606 towards the common node 604.

The current flow is detected by the comparator 610 which is operable to output a single bit to indicate whether the average row voltage of the driven row electrodes is higher or lower than the reference voltage. The single bit is communicated to the digital controller 612 and used to adjust a row reference current for subsequent frames. On receiving the single bit signal the digital controller 612 employs correction logic through a correction logic module 614 to adjust the row reference current $I_{ref}$. A correction lookup table 616 provides determined values for adjustment of $I_{ref}$ which is subsequently stepped up or down depending upon the requirements.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A current matching control apparatus for matching a plurality of current sources and a plurality of current sinks, the plurality of current sinks having a drive current value controlled by a drive processor in accordance with a reference control current and wherein each output of the plurality of current sinks are connected to a common output node, the apparatus comprising: a feedback circuit having (i) an input connected to the common output node of the current sinks, wherein the common output node is connected for providing a signal from the common output node to the input and (ii) an output connected to the drive processor, wherein the feedback circuit is arranged to match a voltage at the common output node to a reference voltage by communicating a signal to the drive processor to adjust the reference control current.

2. An apparatus as claimed in claim 1, wherein each one of the plurality of current sinks is connected to the common output node via a first resistance component.

3. An apparatus as claimed in claim 1, wherein a second resistance component is connected between the common output node and a reference voltage source.

4. An apparatus as claimed in claim 1, wherein the feedback circuit comprises a comparator having a first input connected to sense the reference voltage and a second input connected to sense the voltage at the common output mode.

5. An apparatus as claimed in claim 4, wherein the comparator comprises an output terminal connected to the drive processor.

6. An apparatus as claimed in claim 5, wherein the comparator is programmed to output a signal to indicate whether the reference voltage is higher or lower than the sensed voltage at the common output mode.

7. An apparatus as claimed in claim 1, wherein the apparatus is included in a row driver circuit for a passive matrix driven display.

8. An apparatus as claimed in claim 7, wherein the row driver circuit is connected to the plurality of current sinks and a column driver circuit is connected to the plurality of current sources.

9. An apparatus as claimed in claim 7, wherein the passive matrix driven display is an emissive display.

10. An apparatus as claimed in claim 9, wherein the emissive display comprises an array of individual emissive pixels provided by organic electroluminescent material.

11. An apparatus as claimed in claim 10, wherein the organic electroluminescent material comprises a small molecule organic material or a polymer organic material.

12. A method of matching multiple current sources and sinks in a passive matrix driven organic electroluminescent display comprising: driving a plural set of first electrodes with a first current value; driving a plural set of second electrodes with a second current value; sensing a voltage at a common output node of the plural set of second electrodes; comparing the sensed voltage at the common output node and across the plural set of second electrodes to a reference voltage; and adjusting the second current value so that the sensed voltage steps towards the reference voltage.

13. A method as claimed in claim 12, wherein sensing a voltage across the plural second electrodes includes sensing an average voltage of the plurality of second electrodes.

14. A method as claimed in claim 12, wherein adjusting the second current value includes generating a signal to indicate whether the sensed voltage is higher or lower than the reference voltage.

15. A method as claimed in claim 14, wherein the signal is a single bit.

16. A method as claimed in claim 12, wherein the first electrodes comprise column electrodes and the second electrodes comprise row electrodes of the display and driving said column and row electrodes includes driving with first and second sets of column drive signals and first and second sets of row drive signals respectively.

17. A method as claimed in claim 16, including driving the column electrodes of the display with the first set of column drive signals at the same time as driving two or more row electrodes of the display with the first set of row drive signals; then driving the column electrodes with the second set of column drive signals at the same time as two or more row electrodes are driven with a second set of row drive signals.

18. A method as claimed in claim 16, wherein said first and second column drive signals and said first and second row drive signals are selected such that a desired luminescence of pixels in the display driven by the row and column electrodes is obtained by a substantially linear sum of luminances determined by the first row and column drive signals and luminances determined by the second row and column drive signals.

19. A display driver for a passive matrix organic light emitting diode (OLED) display, the display comprising a matrix of OLEDs and a plurality of row and column electrodes; the row electrodes having a drive current value controlled by a drive processor in accordance with a reference control current and wherein each output of the plurality of row electrodes are connected to a common output node; a feedback circuit having (i) an input connected to the common output node of the plurality of row electrodes, wherein the common output node is connected for providing a signal from the common output node to the input and (ii) an output connected to the drive processor, wherein the feedback circuit is arranged to match a voltage at the common output node to a reference voltage by communicating a signal to the drive processor to adjust the reference control current.

20. The display driver of claim 19, further comprising a plurality of current sources and current sinks.

* * * * *